US005755170A

United States Patent [19]

Tajima et al.

[11] Patent Number: 5,755,170

[45] Date of Patent: May 26, 1998

[54] THREAD CUTTING DEVICE IN A SEWING MACHINE

[75] Inventors: Ikuo Tajima; Tomoaki Anezaki; Masayoshi Hirate, all of Kasugai, Japan

[73] Assignee: Tokai Kogyo Mishin Kabushiki Kaisha, Aichi-ken, Japan

[21] Appl. No.: 712,492

[22] Filed: Sep. 11, 1996

[30] Foreign Application Priority Data

Sep. 13, 1995 [JP] Japan ..... 7-235534

[51] Int. Cl.[6] ..... D05B 65/02

[52] U.S. Cl. ..... 112/292; 112/295

[58] Field of Search ..... 112/292, 295, 112/298, 291, 293, 285, 296, 297

[56] References Cited

U.S. PATENT DOCUMENTS 5,125,351 6/1992 Prais et al. ..... 112/292

5,131,340 7/1992 Tajima et al. ..... 112/292

FOREIGN PATENT DOCUMENTS 3-27473 3/1991 Japan .

*Primary Examiner*—Peter Nerbun

*Attorney, Agent, or Firm*—Dennison, Meserole, Pollack & Scheiner

[57] ABSTRACT

A thread cutting device in a sewing machine includes a fixed knife and a movable knife cooperating with each other to cut a thread. The movable knife is movable to bring a part of the thread to extend below the fixed knife for the cutting operation. A thread protection member is operable to support the thread so as to prevent the thread from breakage prior to the cutting operation through cooperation between the fixed knife and the movable knife. The thread protection member is formed separately from the fixed knife.

9 Claims, 8 Drawing Sheets

THREAD CUTTING DEVICE IN A SEWING MACHINE

FIELD OF THE INVENTION

The present invention relates to a thread cutting device including a fixed knife and a movable knife which cooperate with each other to cut a thread in a sewing machine.

DESCRIPTION OF THE PRIOR ART

A thread cutting device of the type described above is known in the art and is disclosed in Japanese Laid-Open Utility Model Publication No. 3-27473. The cutting device of this publication includes a fixed knife having a thread protection part which is positioned on the upper side of a cutting edge of the fixed knife and which is formed integrally with the fixed knife. The thread protection part has a rounded front end and extends forwardly beyond the cutting edge of the fixed knife.

In order to cut a thread, a movable knife engages a part of the thread and brings the part of the thread to a position where the movable knife intersects the lower side of the fixed knife. Before the fixed knife and the movable knife cooperate with each other to cut the thread, part of the thread contacts the front end of the thread protection member as well as the cutting edge of the fixed knife. Thus, since this part of the thread extends along a path passing the front end of the thread protection member, the thread can be prevented from being intensely contacting the cutting edge of the fixed knife during the movement of the movable knife prior to cooperation between the fixed knife and the movable knife. Therefore, the thread protection member serves to prevent the thread from being broken prior to a normal cutting operation through cooperation between the fixed knife and the movable knife.

However, since the thread protection part is positioned above the cutting edge, it is difficult to form or machine the fixed knife. Particularly, it is difficult to form the cutting edge to have an acute angle in section for an excellent cutting ability. In addition, the fixed knife requires a troublesome sharpening procedure when the cutting ability of the cutting edge has been degraded.

SUMMARY OF THE INVENTION

It is, accordingly, an object of the present invention to provide a thread cutting device in a sewing machine in which a fixed knife can be formed without any difficulty.

It is another object of the present invention to provide a thread cutting device in a sewing machine in which a cutting edge of a fixed knife can be easily formed to have an acute angle in section for an excellent cutting ability.

It is a further object of the present invention to provide a thread cutting device in a sewing machine in which a sharpening operation of a cutting edge of a fixed knife can be easily performed when the cutting ability has been degraded.

According to the present invention, there is provided a thread cutting device in a sewing machine, comprising:

a fixed knife and a movable knife cooperating with each other to cut a thread, the movable knife being movable to bring a part of the thread to extend below the fixed knife for the cutting operation; and a thread protection member operable to support the thread so as to prevent the thread from breakage prior to the cutting operation through cooperation between the fixed knife and the movable knife;

the thread protection member being formed separately from the fixed knife.

With this construction, the fixed knife can be easily formed as a single member. Particularly, a cutting edge of the fixed knife can be easily formed to have an acute angle in section. In addition, when the cutting ability of the cutting edge has been degraded during a long period of use of the cutting device, the fixed knife can be handled independently of the thread protection member, so that the cutting edge can be easily sharpened.

Preferably, the thread protection member is superposed on the fixed knife and is fixed to a knife base below a throat plate by a tightening mechanism such as a screw. With this construction, maintenance works such as a sharpening operation of the cutting edge of the fixed knife can be easily performed. In addition, a thread retainer spring may be provided for retaining the remaining part of the thread after the cutting operation. The thread retainer spring may be positioned on the lower side of the fixed knife and may be secured to the knife base together with the thread protection member and the fixed knife by the tightening mechanism.

Further, the movable knife may include a thread cutting part and a thread separating part formed separately from each other. With this construction, the thread cutting part as well as the thread separating part may be easily formed. In addition, forming or sharpening a cutting edge of the thread cutting part can be easily performed.

Preferably, the thread cutting part is superposed on the thread separating part, and the thread cutting part and the thread separating part are fixed in position relative to each other by a tightening device such as a screw. With this construction, the sharpening operation of the cutting edge of the thread cutting part can be easily performed.

The invention will become more apparent from the appended claims and the description as it proceeds in connection with the drawings.

BRIEF DESCRIPTION OF THE DRAWINGS

FIG. 6(*b*) is a view taken along line VIb—VIb in FIG. 5(*d*);

FIG. 6(*c*) is a view in a direction of arrow VIc in FIG. 5(*a*);

DETAILED DESCRIPTION OF THE PREFERRED EMBODIMENTS

An embodiment of the present invention will now be explained with reference to the drawings.

Figure 1:
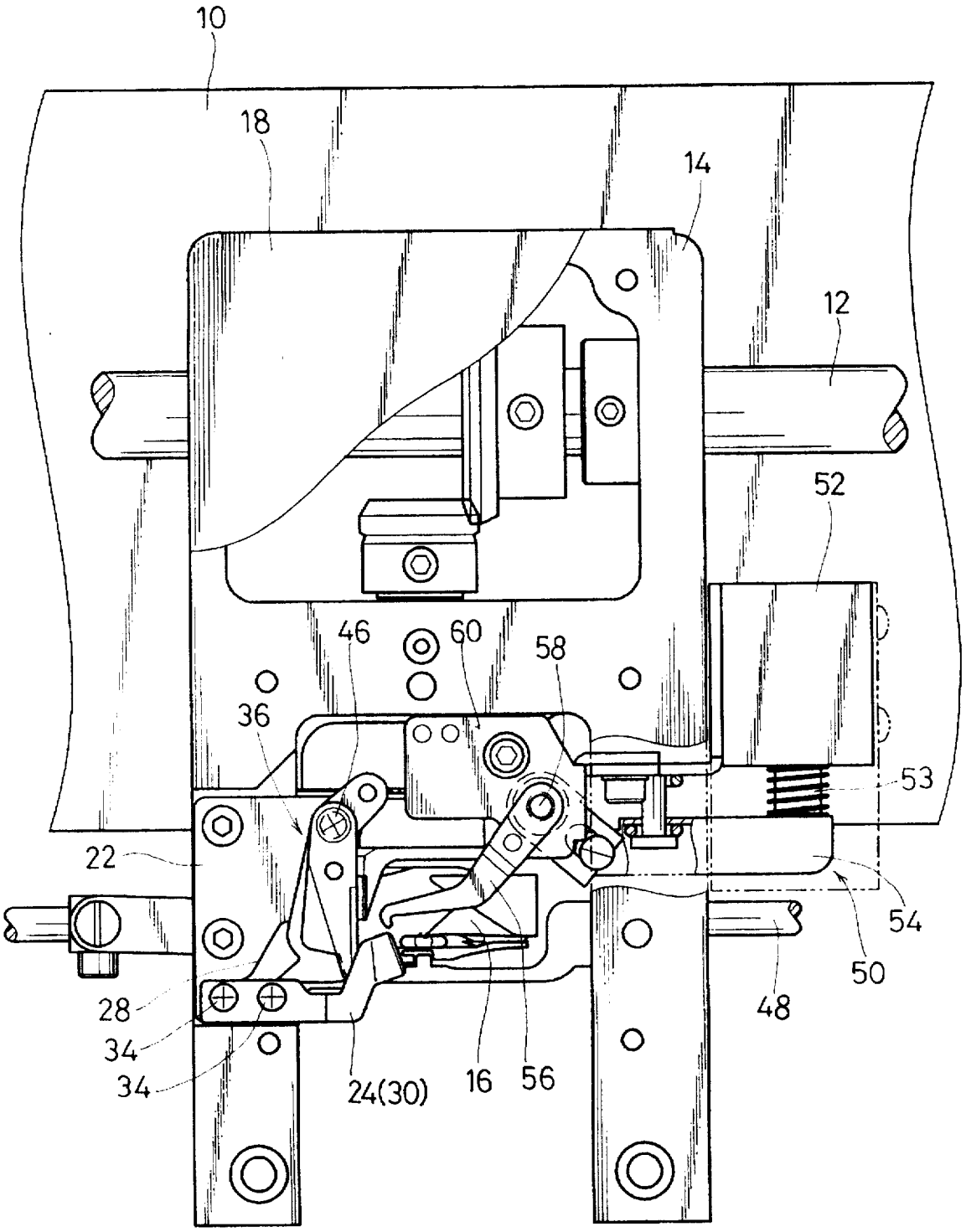
FIG. 1 is a plan view of the essential parts of a sewing machine incorporating a thread cutting device according to an embodiment of the present invention.
Figure 2:
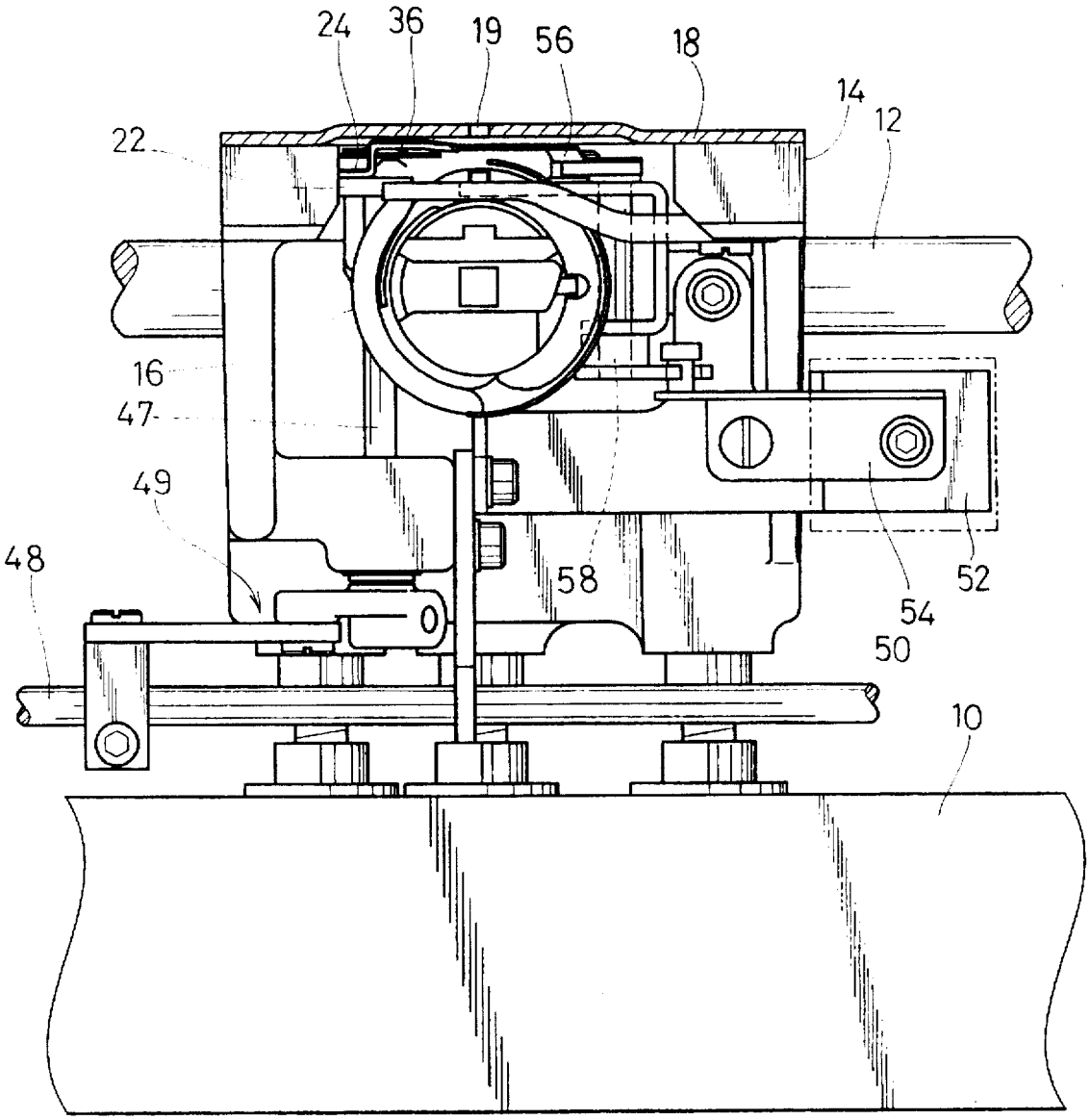
FIG. 2 is a front view of FIG. 1.

A sewing machine incorporating a thread cutting device is partly shown in plan view in FIG. 1. The front view of FIG. 1 is shown in FIG. 2.

The sewing machine includes a machine frame 10 on which a shuttle base 14 is mounted. A throat plate 18 having a needle hole 19 is fixedly mounted on the upper end of the shuttle base 14. A shuttle 16 is mounted on the shuttle base 14 in a position below the needle hole 19 of the throat plate 18. The shuttle 16 is interlocked with a main shaft 12 which is rotatably driven by a drive device (not shown), so that the shuttle 16 is rotated with the main shaft 12 in a manner well known in the art. A knife base 22 is secured to the shuttle base 14 in a position below the throat plate 18 and has a fixed knife 24 and a movable knife 36 mounted thereon.

Figure 3:
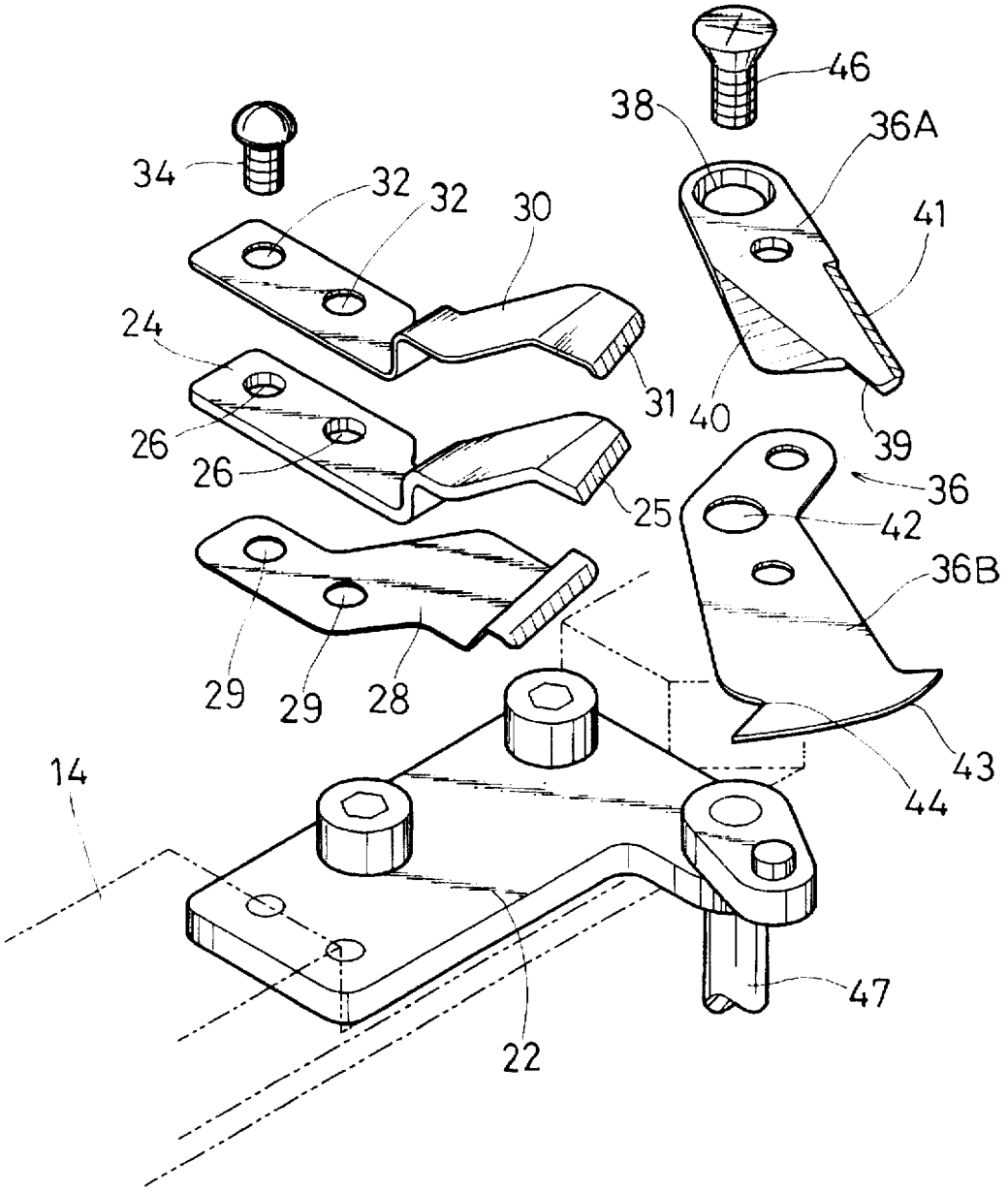
FIG. 3 is an exploded perspective view of a fixed knife, a movable knife and their associated parts of the cutting device.

The fixed knife 24, the movable knife 36 and their associated parts are shown in exploded perspective view in FIG. 3. As will be seen from FIG. 3, a thread protection member 30 and a thread retainer spring 28 are positioned above and below the fixed knife 24, respectively. The fixed knife 24, the thread protection member 30 and the thread retainer spring 28 include mounting holes 26, 32 and 29, respectively. The mounting holes 26, 32 and 29 are two in number, respectively, for inserting two screws 34 (only one shown in FIG. 3), so that the fixed knife 24, the protection member 30 and the thread retainer spring 28 are fixed together to the knife base 22 by means of the screws 34 with the thread protection member 30 and the thread retainer spring 28 positioned above and below the fixed knife 24, respectively. A cutting edge 25 is formed on the front end of the fixed knife 24 and has an acute angle in section. A thread protection part 31 is formed on the front end of the thread protection member 30 and is configured to extend over the cutting edge 25 of the fixed knife 24.

The movable knife 36 includes a thread cutting member 36A and a thread separating member 36B. A vertical knife shaft 47 is rotatably supported on the knife base 22. The thread cutting member 36A and the thread separating member 36B include mounting holes 38 and 42, respectively, for inserting a screw 46, so that the movable knife 36 is secured to the upper end of the knife shaft 47 by means of the screw 46 with the thread separating part 36B positioned below the thread cutting member 36B. The knife shaft 47 is reciprocally rotated by a drive shaft 48 by means of a link mechanism 49 shown in FIG. 2, so that the movable knife 36 is reciprocally pivotally moved. The drive shaft 48 is disposed below the shuttle base 14 and is slidably reciprocally moved in its axial direction by a drive device (not shown).

As shown in FIG. 3, the thread cutting member 36A has a cutting edge 39 formed on one end thereof and is positioned on one side in the pivotal direction of the movable knife 36 (on the side in a clockwise direction). Inclined surfaces 40 and 41 are formed on both sides of the thread cutting member 36A in the pivotal direction of the movable knife 36. Here, the inclined surface 40 is positioned on the same side as the cutting edge 39 and is positioned radially inwardly of the cutting edge 39. In addition, the inclined surface 40 extends beyond the cutting edge 39 in the clockwise direction. On the other hand, the thread separating member 36B has a thread separating portion 43 and a thread engaging portion 44 positioned on the side in the counterclockwise direction and on the side in the clockwise direction, respectively.

As will be best seen from FIG. 5(*b*), in the mounting state of the movable knife 36, the thread engaging portion 44 is positioned radially outwardly of the inclined surface 40 and is spaced from the cutting edge 39 in the clockwise direction. In addition, the thread separating portion 43 extends in the counterclockwise direction beyond the inclined surface 41.

Figure 7A:
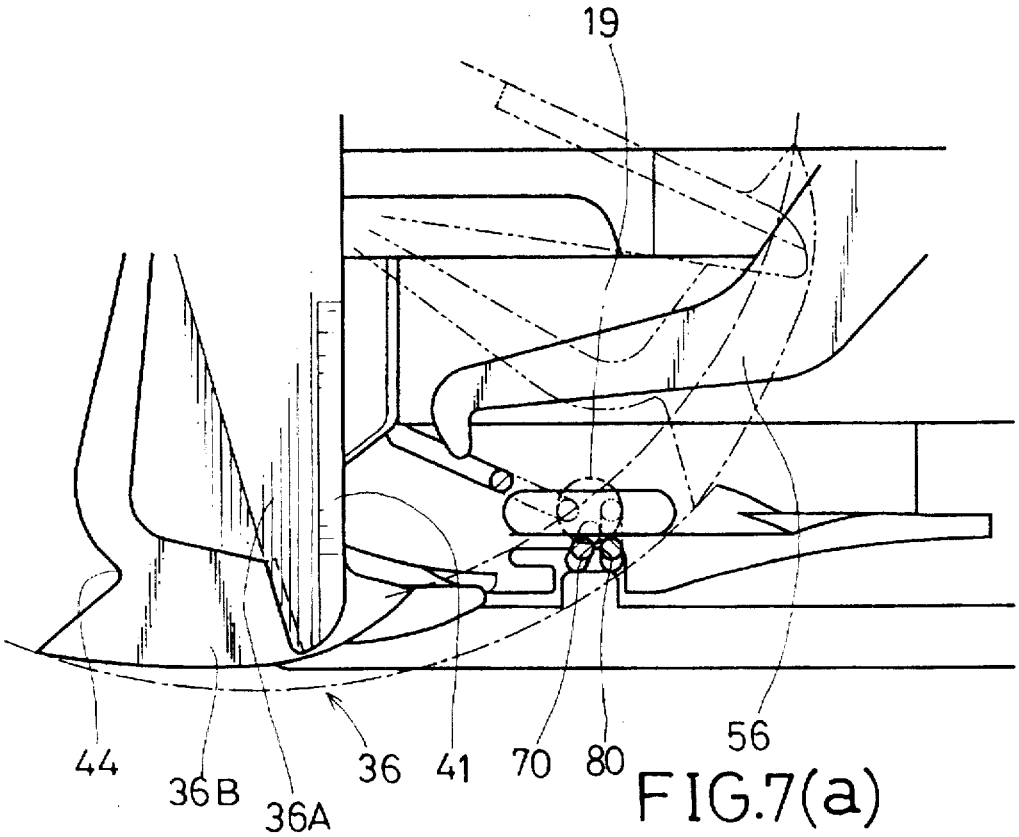
FIGS. 7(*a*) and 7(*b*) are plan views showing the operational relationship between the thread cutting device and the thread selection device.
Figure 7B:
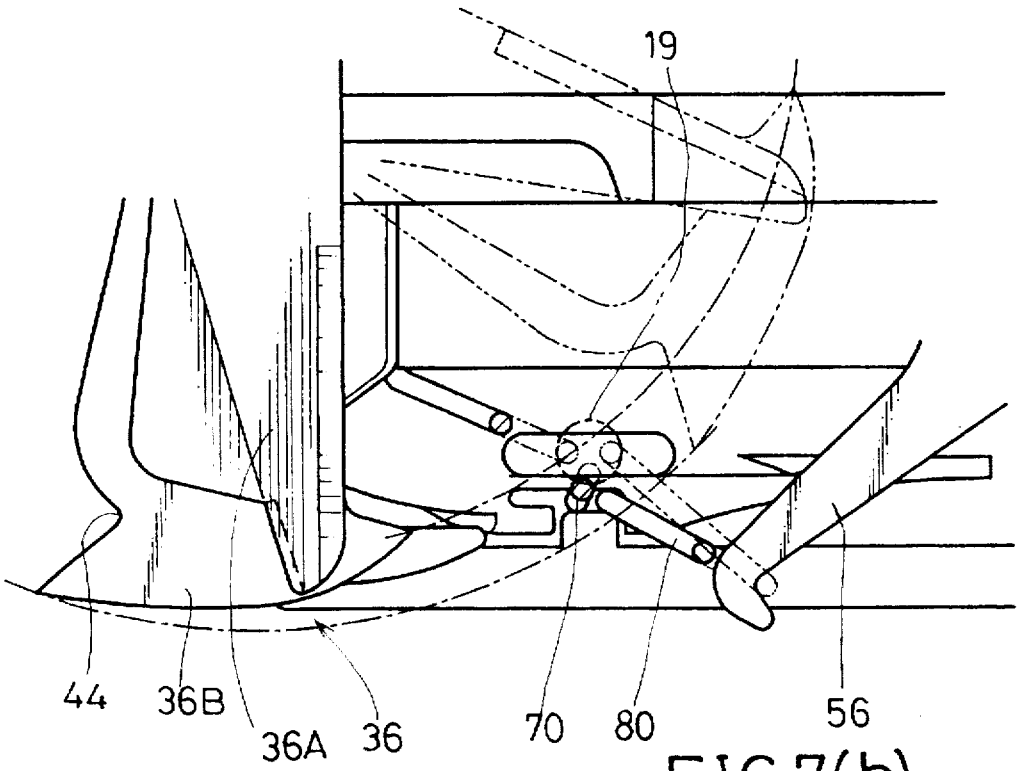

As shown in FIGS. 1 and 2, a thread selection device 50 is mounted on the shuttle base 14 for selection between the operation for cutting both an upper thread 70 and a lower thread 80 (see FIGS. 7(*a*) and 7(*b*)) and the operation for cutting only the upper thread 70 by the thread cutting device.

The thread selection device 50 will now be described in brief. A lever shaft 58 is rotatably mounted on a lever bracket 60 which is secured to the shuttle base 14. The lever shaft 58 extends in parallel to the knife shaft 47 and has an upper end on which a thread refuge lever 56 is fixedly mounted. A solenoid 52 is mounted on the lateral side of the shuttle base 14 and has a plunger 53 which is connected to the lever shaft 58 via a drive lever 54, so that the lever shaft 58 is pivoted by the actuation of the plunger 53. More specifically, when the solenoid 52 is not excited, the thread refuge lever 56 is held in a waiting position shown in FIG. 1. On the other hand, when the solenoid 52 is excited, the thread refuge lever 56 is pivoted to an operative position shown in FIG. 4.

The movement of the movable knife 36 during the cutting operation is shown in sequence in FIGS. 5(*a*) to 5(*e*) and the cutting operation will now be explained in connection with the operation for cutting only the upper thread 70. The movable knife 36 is normally positioned in a position shown in FIG. 5(*a*) which corresponds to the position shown in FIG. 1. In order to cut the upper thread 70, the movable knife 36 is pivoted in the forward direction about the axis of the knife shaft 47 from the position shown in FIG. 5(*a*) to a position shown in FIG. 5(*b*). With such pivotal movement, the thread separating portion 43 of the thread separating member 36B enters between an upper fabric thread part and an upper needle thread part of the upper thread 70 so as to separate them from each other. Here, the upper fabric thread part and the upper needle thread part are parts of the upper thread 70 on the side of a work fabric (not shown) and on the side of a sewing needle (not shown), respectively.

As the movable knife 36 is further pivoted in a reverse direction from the position shown in FIG. 5(*b*) to the position shown in FIG. 5(*e*) in sequence via the positions shown in FIGS. 5(*c*) and 5(*d*), the upper fabric thread part is engaged by the thread engaging portion 44 of the thread separating member 36B when the thread engaging portion 44 passes below the needle hole 19 of the throat plate 18.

Figure 6A:
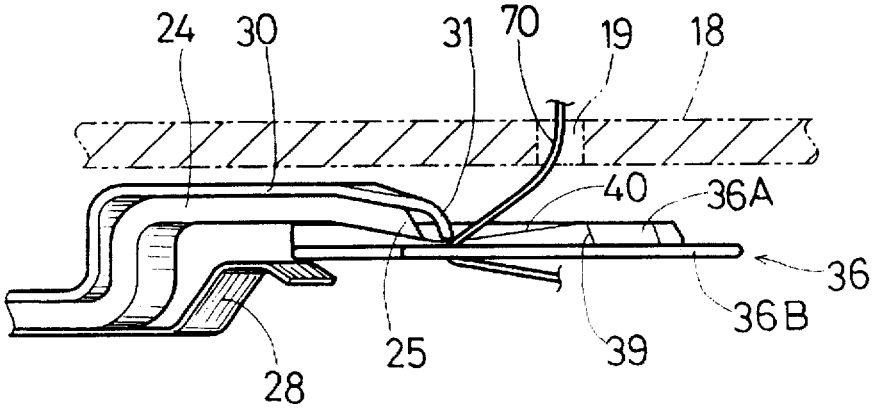
FIG. 6(*a*) is a view in a direction of arrow VIa in FIG. 5(*c*)
Figure 6B:
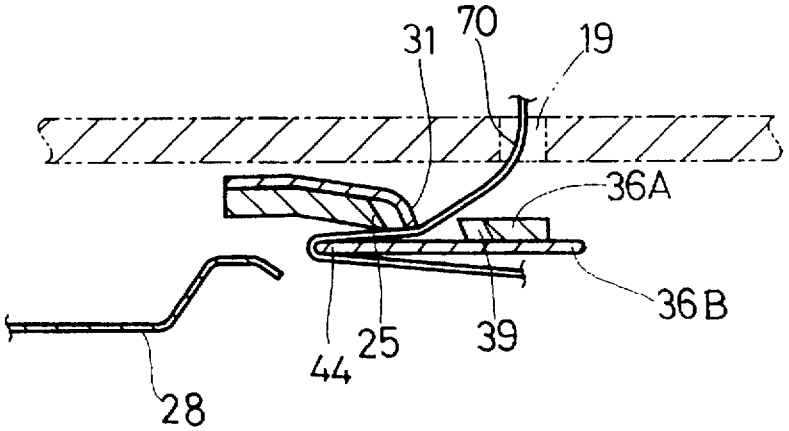
Figure 6C:
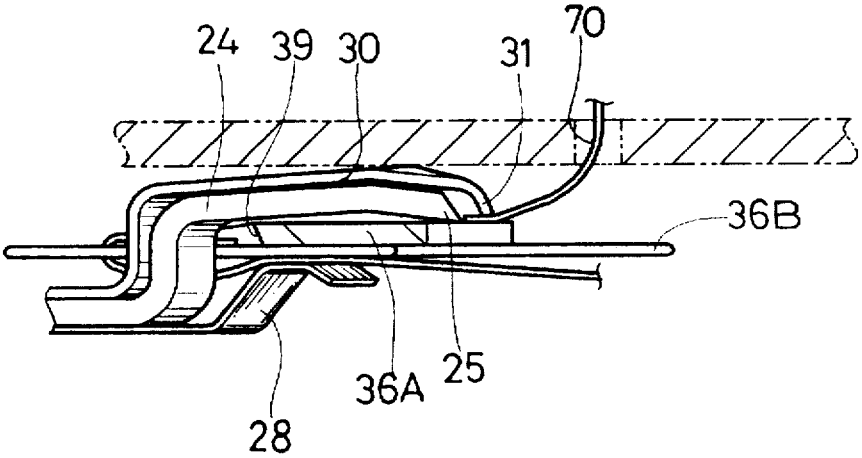

On the other hand, as the movable knife 36 is pivoted from the position shown in FIG. 5(*b*) to the position shown in FIG. 5(*c*), the inclined surface 40 of the thread cutting part 36A contacts the thread protection part 31 of the thread protection member 30 (see FIG. 6(*a*) showing a view in a direction of arrow VIa in FIG. 5(*c*)) and subsequently contacts the cutting edge 25 of the fixed knife 24. Here, the contacting positions of the thread protection part 31 and the cutting edge 25 on the inclined surface 40 are determined to be slightly above the lower end of the inclined surface 40.

As the movable knife 36 is further pivoted toward the position shown in FIG. 5(*e*), the thread protection part 31 of the thread protection member 30 and the cutting edge 25 of the fixed knife 24 are slightly lifted by the movable knife 36 due to contact with the inclined surface 40. More specifically, a space is increased between the upper surface of the thread separating member 36B adjacent the thread separation portion 44 and the thread protection member 30 as well as the cutting edge 25.

When the movable knife 36 reaches the position shown in FIG. 5(*e*), the cutting edge 39 of the thread cutting part 36A of the movable knife 36 intersects the cutting edge 25 of the fixed knife 24, so that the upper thread 70 is cut. Since the fixed knife 24 is resiliently deformed due to lifting of its cutting edge 25 through contact with the inclined surface 40, the cutting edge 25 is forced to contact the cutting edge 39 of the thread cutting member 36A, so that the cutting operation of the upper thread 70 can be reliably performed.

The movable knife 36 is then further pivoted to return to the position shown in FIG. 5(*a*). At this stage, as shown in FIG. 6(*c*) which is a view in a direction of arrow VIc in FIG. 5(*a*), the cut end of the thread on the side of the needle is pinched and retained between the thread retainer spring 28 and the thread separating portion 36B of the movable knife 36.

Meanwhile, during the cutting operation described above, the upper fabric thread part is engaged by the movable knife 36 so as to extend below the fixed knife 24 substantially after the movable knife 36 has been moved further from the position shown in FIG. 5(*c*). The situation of the upper fabric thread part in this state will now be explained with reference to FIG. 5(*d*) showing the movable knife 36 in a middle position between the positions shown in FIG. 5(*c*) and FIG. 5(*e*). As will be seen from FIG. 6(*b*) which is a sectional view taken along line VIb—VIb in FIG. 5(*d*), the upper fabric thread part contacts the front end of the thread protection part 31 in a position between the needle hole 19 of the throat plate 18 and the thread engaging portion 44 of the thread separating member 36B while the upper fabric thread part softly contacts the cutting edge 25 of the fixed knife 24.

Although the movable knife 36 is further moved toward the position shown in FIG. 5(*a*), the upper fabric thread part of the upper thread 70 is held so as to not intensely contact the cutting edge 25 of the fixed knife 24. Thus, as described above, the cutting edge 25 of the fixed knife 24 as well as the thread protection part 31 of the thread protection member 30 is slightly lifted through contact with the inclined surface 40 of the thread cutting part 36A, so that the space is increased between the upper surface of the thread separating member 36B adjacent the thread separation portion 44 and the thread protection member 30 as well as the cutting edge 25. Therefore, the upper thread 70 is prevented from breakage through intensive frictional contact with the cutting edge 25 of the fixed knife 24 prior to the cutting operation through cooperation between the cutting edge 25 of the fixed knife 24 and the cutting edge 39 of the thread cutting part 36A.

Although the cutting operation has been described in connection with the operation for cutting only the upper thread 70, the cutting device of this embodiment is operable to selectively cut only the upper thread 70 or both the upper thread 70 and the lower thread 80 by means of the thread selection device 50.

FIGS. 7(*a*) and 7(*b*) are enlarged plan views of the thread cutting device and the thread selection device 50 and show the operational relationship therebetween. When the solenoid 52 is not excited to hold the thread refuge lever 56 in the waiting position shown in FIG. 1, both the upper thread 70 (the upper fabric thread part) and the lower thread 80 are positioned in a moving path of the movable knife 36. Therefore, in this case, both the upper thread 70 and the lower thread 80 are engaged by the thread engaging portion 44 of the thread separating member 36A of the movable knife 36 and are cut in the same manner as described above.

In this case, even if the thread refuge lever 56 has been deformed to be curved downwardly, the thread refuge lever 56 in the waiting position is lifted by the inclined surface 41 of the thread cutting part 36A of the movable knife 36 which intersects the thread refuge lever 56 when the movable knife 36 is pivoted from the position shown by solid lines to the position shown by chain lines in FIG. 7(*a*).

Figure 4:
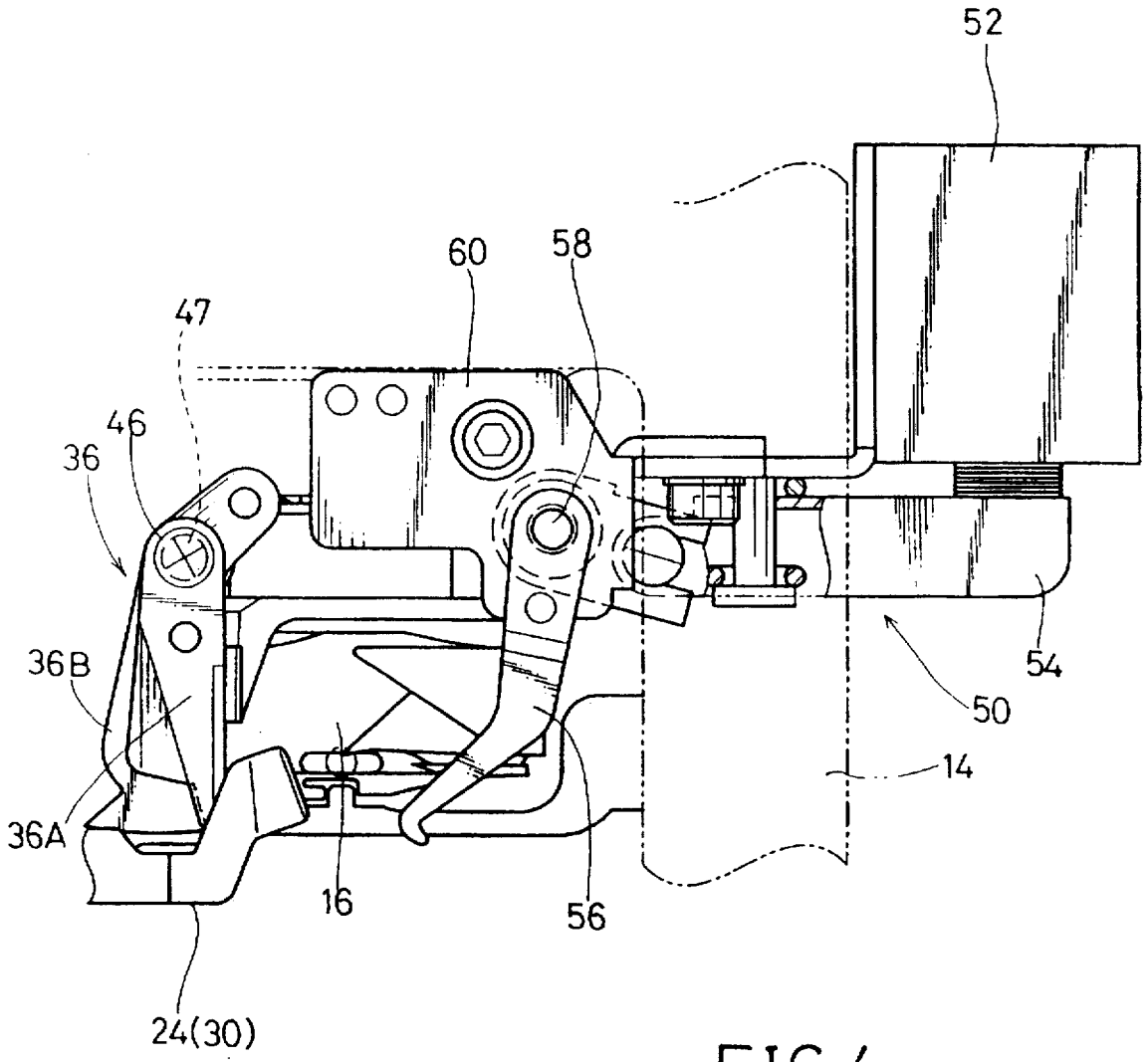
FIG. 4 is a plan view of the thread cutting device with a thread transferring lever of a thread selection device pivoted in its operational position.
Figure 5A:
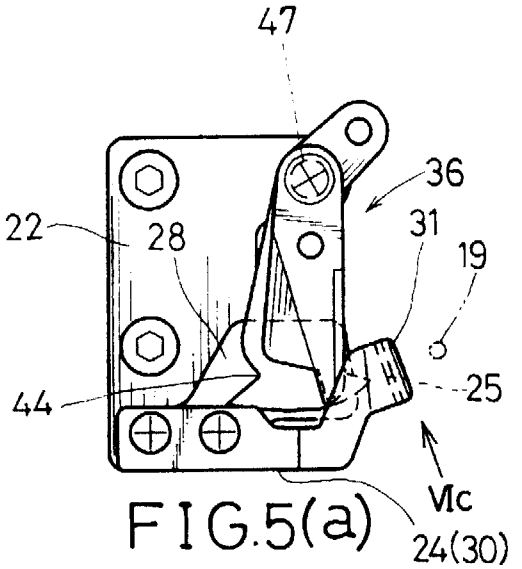
FIGS. 5(*a*) to 5(*e*) are explanatory plan views showing various operations of the thread cutting device.
Figure 5B:
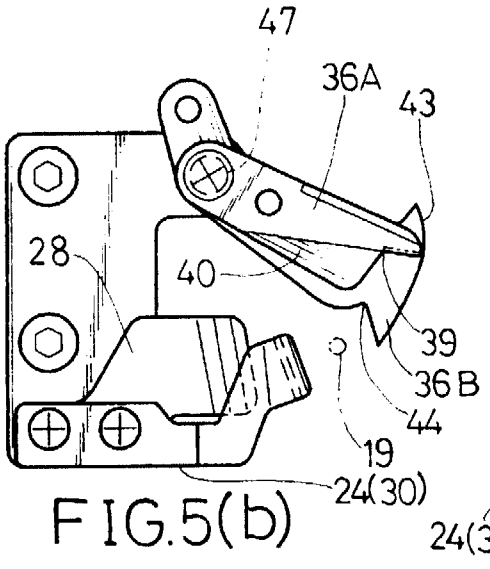
Figure 5C:
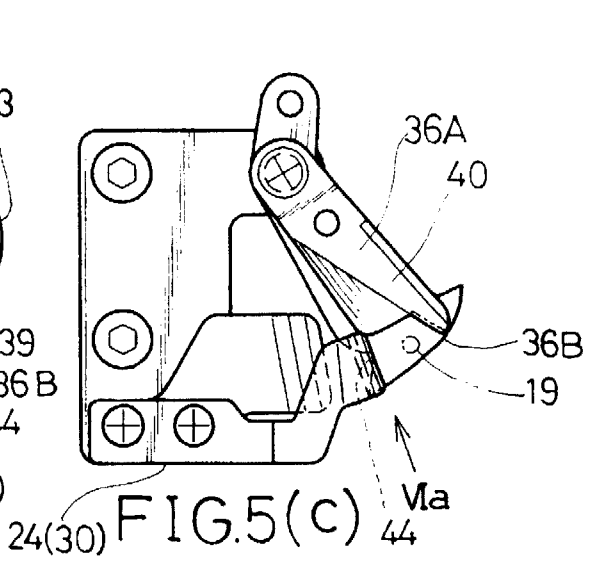
Figure 5D:
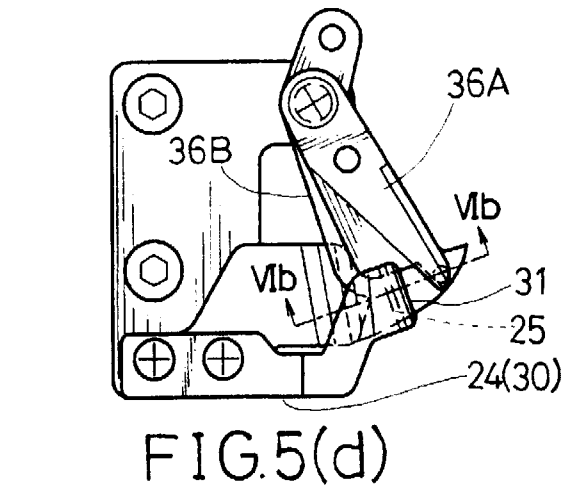
Figure 5E:
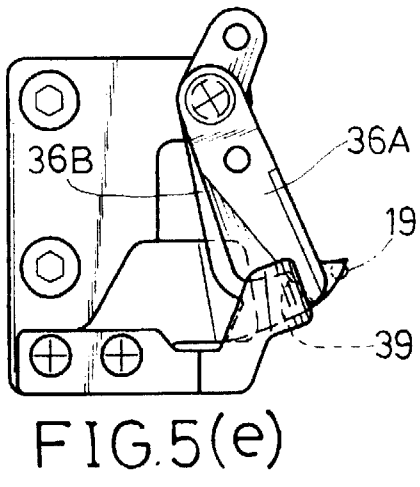

When the solenoid 52 is excited to pivot the thread refuge lever 56 to the operational position shown in FIG. 4, the lower thread 80 is refuged by the thread refuge lever 56 to a position away from the moving path of the movable knife 36 as shown in FIG. 7(*b*). Therefore, in this case, only the upper thread 70 is engaged by the thread engaging portion 44 of the thread separating member 36B so as to be cut.

The thread selection device 50 is useful since it provides selection between the cutting operation of both the upper thread 70 and the lower thread 80 and the cutting operation of only the upper thread 70. However, the thread selection device 50 can be eliminated if the cutting device is intended to be always operated in a single operation mode which may be the operation mode for cutting both the upper thread 70 and the lower thread 80.

As described above, with this embodiment, since the fixed knife 24 and the thread protection part 30 are formed separately from each other, the fixed knife 24 can be easily formed, and the cutting edge 25 can be easily shaped to have an acute angle in section. In addition, when the cutting ability of the cutting edge 25 has been degraded, the operator can remove the fixed knife 24 together with the thread retainer spring 28 and the thread protection part 30 from the knife base 22 by loosening the screws 34, so that the fixed knife 24 can be handled independently of the other parts for sharpening the cutting edge 25.

Although, in the above embodiment, the thread protection member 30 is secured to the knife base 22 together with the fixed knife 24, the thread protection member 30 may be secured to the knife base 22 independently of the fixed knife or may be secured to another base member such as the shuttle base 14.

Figure 8:
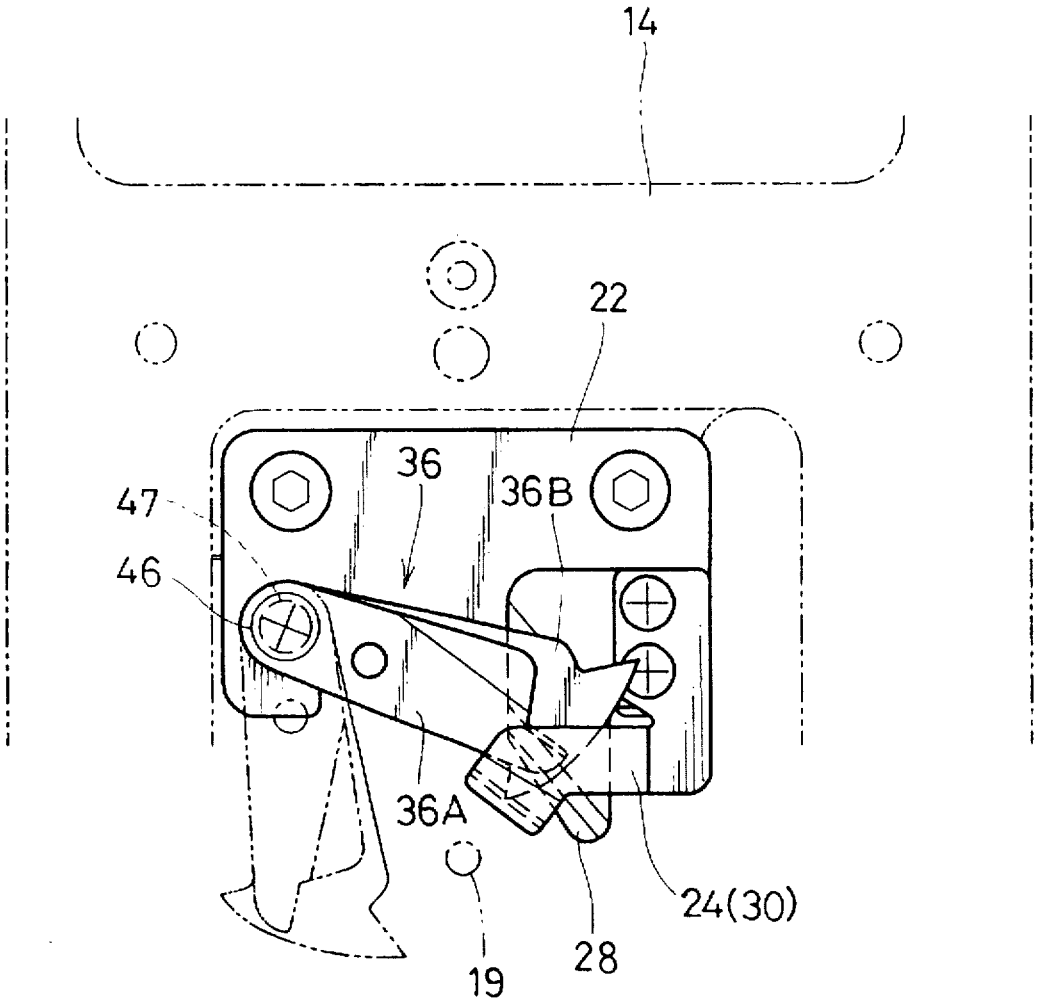
FIG. 8 is a plan view showing the thread cutting device in which the movable knife is operated in a different manner.

In addition, although, in the above embodiment, the movable knife 36 is pivoted in the counterclockwise direction (forward direction) in FIG. 1 for the thread separating operation and is pivoted in the clockwise direction (reverse direction) for the thread cutting operation, the moving direction of the movable knife 36 may be inverted such that the movable knife 36 is pivoted in the clockwise direction (forward direction) from a position shown by solid lines to a position shown by chain lines in FIG. 8 for the upper thread separating operation and is pivoted in the counterclockwise direction (reverse direction) for the thread cutting operation.

Further, the movable knife 36 may be linearly reciprocally moved for performing the thread separating operation and the thread cutting operation.

While the invention has been described with reference to a preferred embodiment thereof, it is to be understood that modifications or variations may be easily made without departing from the spirit of this invention which is defined by the appended claims.

What is claimed is:

1. A thread cutting device in a sewing machine, comprising:

a fixed knife and a movable knife cooperating with each other to cut a thread, said movable knife being movable to bring a part of the thread to extend below said fixed knife for the cutting operation;

a thread protection member operable to support the thread so as to prevent the thread from breakage prior to a cutting operation through cooperation between said fixed knife and said movable knife;

a mounting portion provided on the sewing machine for mounting said fixed knife and said movable knife;

said thread protection member being separate from said fixed knife, and tightening means for removably mounting and removing said thread protection member on and from said mounting portion independently of said fixed knife.

2. The thread cutting device as defined in claim 1 wherein said mounting portion is a knife base positioned below a throat plate, and said tightening means releasably securing said thread protection member and said fixed knife to each other and to said knife base with said thread protection member superimposed on the fixed knife.

3. The thread cutting device as defined in claim 2 further including a thread retainer spring for retaining the remaining part of the thread after the cutting operation, said thread retainer spring underlying said fixed knife and being secured to said knife base together with said thread protection member and said fixed knife by said tightening means.

4. The thread cutting device as defined in claim 1 wherein said movable knife includes a thread cutting part and a thread separating part formed separately from each other.

5. The thread cutting device as defined in claim 4 wherein said cutting part is superposed on said thread separating part, and wherein said cutting part and said thread separating part are fixed in position relative to each other by a further tightening means.

6. The thread cutting device as defined in claim 5 wherein said tightening means and said further tightening means each comprise screw-threaded fasteners.

7. The thread cutting device as defined in claim 3 wherein said movable knife includes a thread cutting part and a thread separating part separate from said thread cutting part, said thread cutting part being superimposed on said thread separating part, and further tightening means removably engaging said cutting part and said thread separating part to releasably position said cutting part and said thread separating part relative to each other.

8. The thread cutting device as defined in claim 7 wherein each of said tightening means and said further tightening means comprises at least one elongate removable fastener received through said thread protection member, fixed knife and thread retainer spring, and at least one elongate removable fastener received through said thread cutting part and said thread separating part of said movable knife.

9. The thread cutting device as defined in claim 8 wherein said fasteners comprise screw-threaded members.

* * * * *